US006370717B1

(12) United States Patent
Kao

(10) Patent No.: US 6,370,717 B1
(45) Date of Patent: Apr. 16, 2002

(54) BED MATTRESS ASSEMBLY

(76) Inventor: Pei-Chin Kao, 2-2F, No.399, Chingkuo Road, Taoyuan City (TW)

( * ) Notice: Subject to any disclaimer, the term of this patent is extended or adjusted under 35 U.S.C. 154(b) by 0 days.

(21) Appl. No.: 09/667,636

(22) Filed: Sep. 22, 2000

(30) Foreign Application Priority Data

Oct. 22, 1999 (TW) ..... 88217991

(51) Int. Cl.[7] ..... A47C 27/045; A47C 27/04; A47C 31/02

(52) U.S. Cl. ..... 5/723; 5/722; 5/716; 5/720; 5/691

(58) Field of Search ..... 5/722, 723, 691, 5/692, 716, 717, 720, 721, 727, 732, 737, 738, 739, 655.8

(56) References Cited

U.S. PATENT DOCUMENTS 1,153,644 A * 9/1915 Rilling ..... 5/722 X
1,296,068 A * 3/1919 Gainer ..... 5/723
1,339,250 A * 5/1920 Winn ..... 5/723 X
1,343,620 A * 6/1920 Gainer ..... 5/723 X
1,784,294 A * 12/1930 Kriege ..... 5/723
2,119,706 A * 6/1938 Drexler et al. ..... 5/692
2,154,910 A * 4/1939 Magaril ..... 5/722
2,978,715 A * 4/1961 Blecker ..... 5/716
3,014,225 A * 12/1961 Pink ..... 5/723 X
3,055,021 A * 9/1962 Rymland ..... 5/716
3,256,535 A * 6/1966 Anson ..... 5/716
3,308,492 A * 3/1967 Lovette ..... 5/722
3,493,980 A * 2/1970 Haller ..... 5/716
3,626,523 A * 12/1971 Robins ..... 5/716
3,728,747 A * 4/1973 Docker ..... 5/692
4,019,451 A * 4/1977 Autrey ..... 5/716 X
4,075,721 A * 2/1978 Autrey ..... 5/716
4,788,731 A * 12/1988 Yokoi et al. ..... 5/721
4,866,799 A * 9/1989 Glackin ..... 5/716 X
4,868,941 A * 9/1989 Tai ..... 5/720
5,311,624 A * 5/1994 Hutchinson ..... 5/720 X
5,432,964 A * 7/1995 Strell ..... 5/716
5,435,026 A * 7/1995 Cavazos ..... 5/716
5,615,435 A * 4/1997 Wells et al. ..... 5/716
5,644,811 A * 7/1997 Cavazos ..... 5/738
5,768,726 A * 6/1998 Myles ..... 5/737
5,860,200 A * 1/1999 Wells et al. ..... 5/716 X
5,896,605 A * 4/1999 Branman ..... 5/716
6,023,803 A * 2/2000 Barman ..... 5/716
6,122,787 A * 9/2000 Kao ..... 5/723
6,233,760 B1 * 5/2001 Cavazos ..... 5/716 X

FOREIGN PATENT DOCUMENTS

GB 729835 A * 5/1955

* cited by examiner

*Primary Examiner*—Robert G. Santos
(74) *Attorney, Agent, or Firm*—Shoemaker and Mattare

(57) ABSTRACT

A bed mattress assembly is disclosed. The bed mattress assembly includes at least one bed mattress unit having a frame to be coupled with at least a buffer pad. At least one cover fitted over the buffer pad is capable of being releasably clamped by a plurality of clamping elements so as to retain the cover in position relative to the frame. At least one of the claming elements extends over the joint between two adjacent bed mattress units, allowing the two adjacent bed mattress units to be jointed into an integral structure.

3 Claims, 6 Drawing Sheets

BED MATTRESS ASSEMBLY

BACKGROUND OF THE INVENTION

1. Field of the Invention

The present invention relates to bed mattresses and, more particularly, to a bed mattress assembly having a plurality of springs attached to a buffer pad for supporting a human body to rest thereon.

2. Description of Related Art

A conventional bed mattress 90, as shown in FIG. 6, comprises a plurality of compression springs 91 enclosed within a frame, and two buffer pads 92 respectively disposed on a top face and a bottom face of the frame. A cover 93 is stretched over the frame to retain the springs 91 and the buffer pads 92 in position within the frame. The cover 93 is a single sheet securely attached to the frame making the cover unchangeable when desired to be replaced with a new one and unwashable when required to be cleaned.

Another drawback of such kind of conventional bed mattress is that the bed mattress is usually of a fixed size, making it inconvenient to be transported or stored. The problem of the transportation or storage of the bed mattress becomes more troublesome as the bed mattress is of a larger size.

SUMMARY OF THE INVENTION

The primary objective of the present invention is to provide a bed mattress assembly which is capable of removing the cover from the frame for replacement purpose.

Another objective of the present invention is to provide a bed mattress assembly which is convenient in transportation and flexible in storage when compared with the prior art.

In accordance with the above and other objectives, the bed mattress assembly of the present invention comprises at least one bed mattress unit. Each of the bed mattress unit comprises a frame having an outer surface; a plurality of springs securely disposed within the frame; at least one buffer pad coupled to the frame and supported by the springs disposed under the buffer pad, the buffer pad having a top surface and an opposing bottom surface; at least one cover having a sheet portion for covering the top surface of the buffer pad and a skirt portion peripherally attached to the sheet portion and being capable of covering the outer surface of the frame; and a plurality of clamping means coupled to the frame in order to releasably clamp the skirt portion of the cover between the frame and the clamping means, allowing the cover to be retained in position relative to the frame, the clamping means being adapted to detachably laterally combine one bed mattress unit with another.

On the outer surface of the frame there may be formed with at least one recess for engagement with the clamping means so as to retain the clamping means in position with the frame, while the skirt portion of the cover is clamped between the frame and the clamping means. To further enhance the engagement of the frame with the clamping means, a plurality of first securing means, such as screws, are provided on the bottom side of the recess formed on the outer surface of the frame for being engaged with a plurality of second securing means, such as screw caps. In this case, the skirt portion of the cover and the clamping means are respectively formed with a series of openings for receiving the corresponding first securing means therethrough, such that upon completion of the engagement of the first securing means with the second securing means the clamping means as well as the cover are securely attached to the frame.

DETAILED DESCRIPTION OF THE PREFERRED EMBODIMENT

Figure 1:
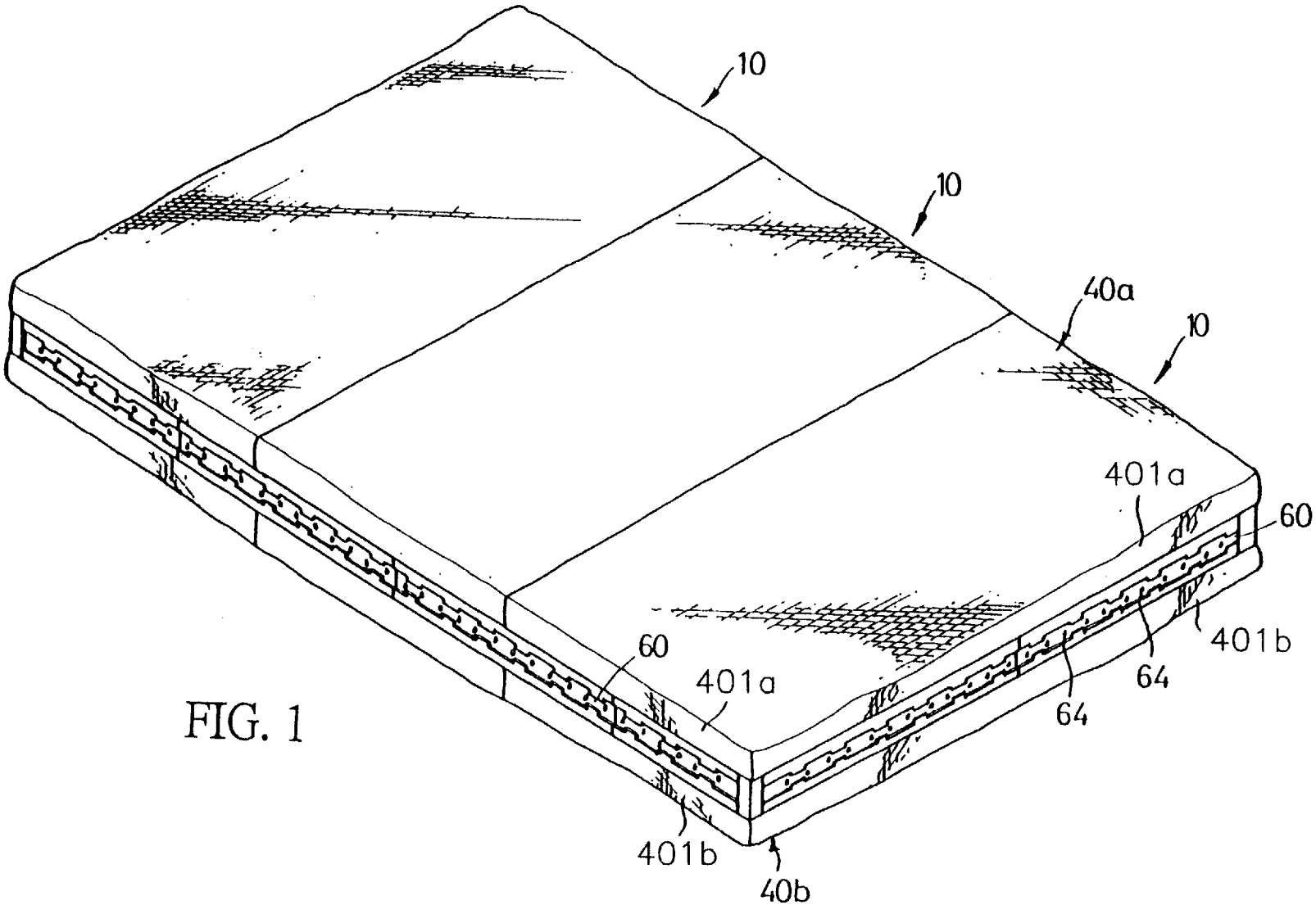
FIG. 1 is a top perspective view of a bed mattress assembly in accordance with the present invention.
Figure 2:
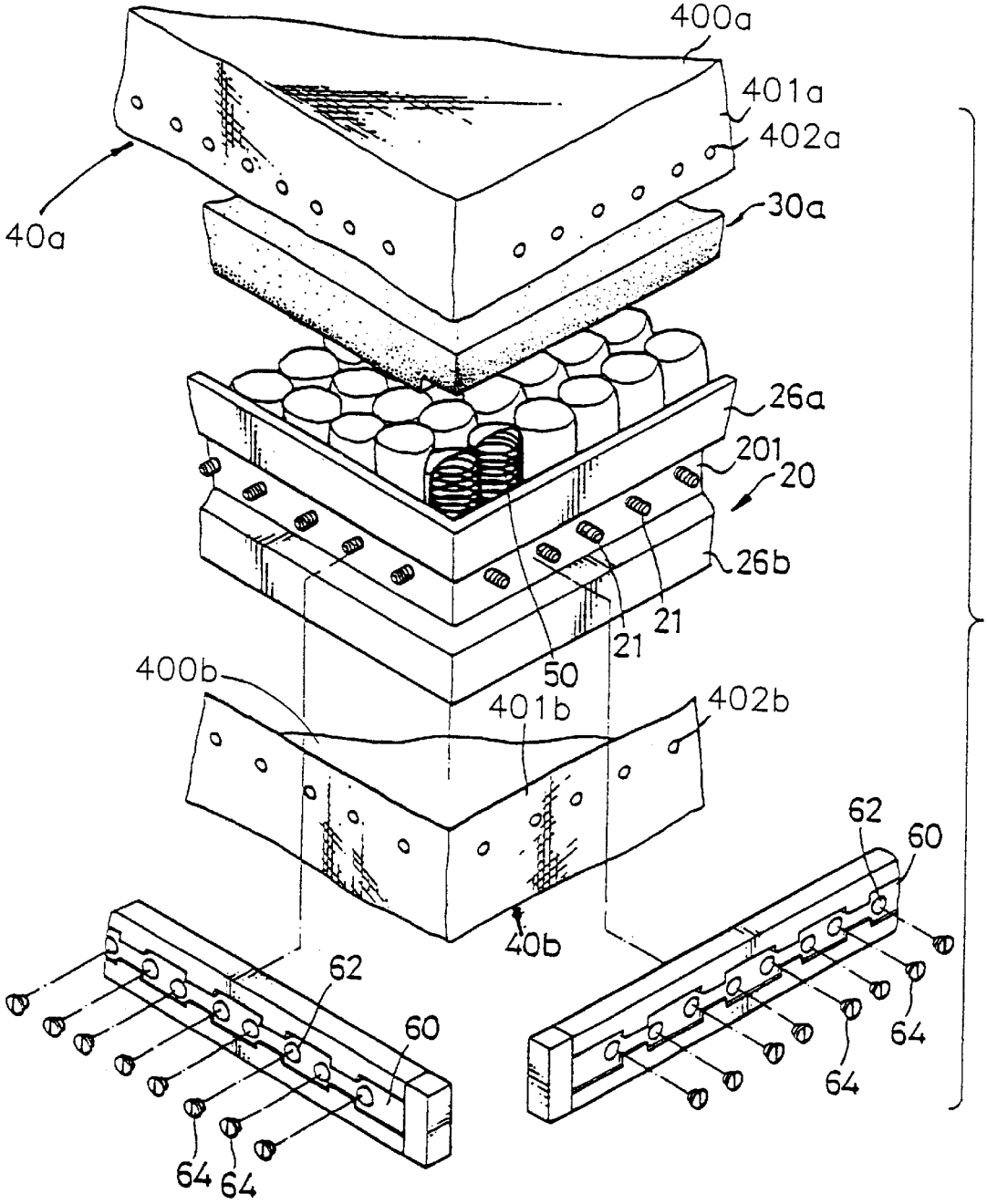
FIG. 2 is an exploded perspective partial view of the bed mattress assembly of FIG. 1.

Referring to FIGS. 1 and 2, a sectioned bed mattress assembly is disclosed which is consisted of a plurality of bed mattress units 10. The bed mattress units 10 are identical and each comprise a frame 20, a top and a bottom buffer pad 30*a*, 30*b*, a top and a bottom cover 40*a*, 40*b*, a plurality of springs 50, a plurality of clamps 60, and a plurality of studs 21. As the bed mattress units 10 are identical numeral references hereinafter are made in the singular. It should also be noted that the bed mattress units 10 can be free from the inclusion of the bottom buffer pad 30*b* and the bottom cover 40*b* as they are optional and subject to the design choice.

The frame 20 is rectangular in shape in this embodiment but can be of any shape commonly found in bed design. A recess 201 extends contiguously around an outer surface of the frame 20, and the plurality of studs 21 are embedded in a bottom side defining the recess 201, at regular intervals. The frame 20 further includes a top flange 26*a* and a bottom flange 26*b* each contiguously extending therearound.

The plurality of springs 50 are securely disposed by conventional methods within the frame 20 so as to provide an elastic support to the top buffer pad 30*a* abutting against the springs 50 while a human body is resting thereon. Each spring 50 is contained within a packet whereby sharp tips at either end thereof are covered to prevent damage to the buffer pads 30*a*, 30*b*.

As the top and bottom buffer pads 30*a*, 30*b* are secured with the frame 20, the springs 50 are interposed therebetween. By this arrangement, the top and bottom buffer pads 30*a*, 30*b* are both elastically supported by the spring 50.

Figure 3:
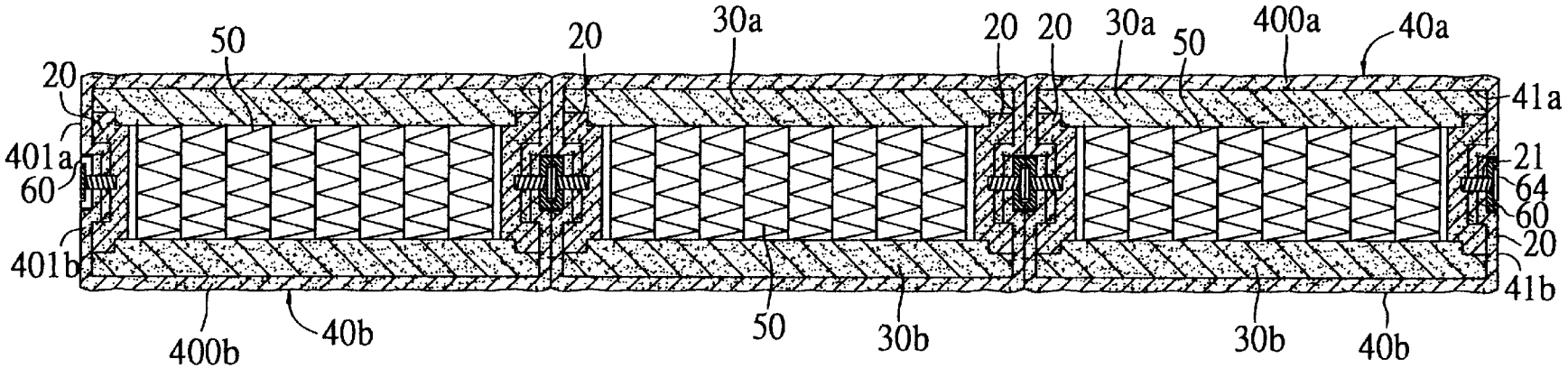
FIG. 3 is a cross-sectional side view of the bed mattress assembly of FIG. 1.

Still referring to FIGS. 1 and 2, and further to FIG. 3, the top cover 40*a* is formed with a sheet portion 400*a* fitted cover the top buffer pad 30*a* and a skirt portion 401*a* peripherally attached to the sheet portion 400*a* for covering the outer surface of the frame 20. Likewise, the bottom cover 40*b* is formed with a sheet portion 400*b* fitted over the bottom buffer pad 30*b* and a skirt portion 401*b* peripherally attached to the sheet portion 400*b* for covering the outer surface of the frame 20.

Figure 4:
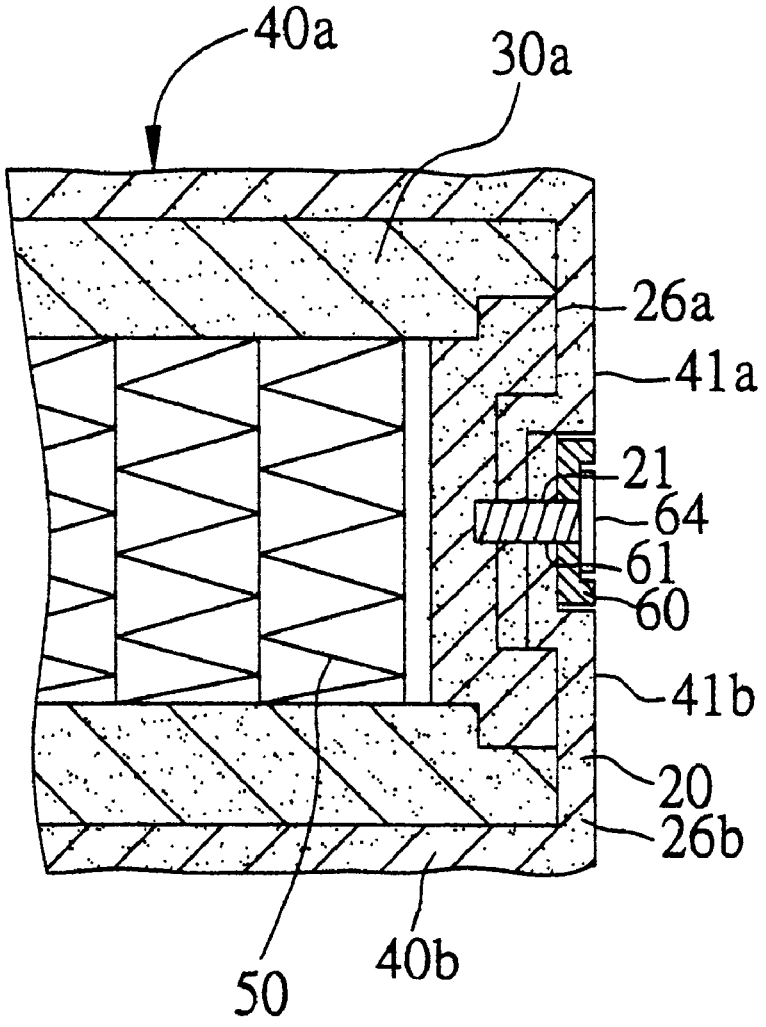
FIG. 4 is an enlarged cross-sectional view of part of the bed mattress assembly of FIG. 1.
Figure 5:
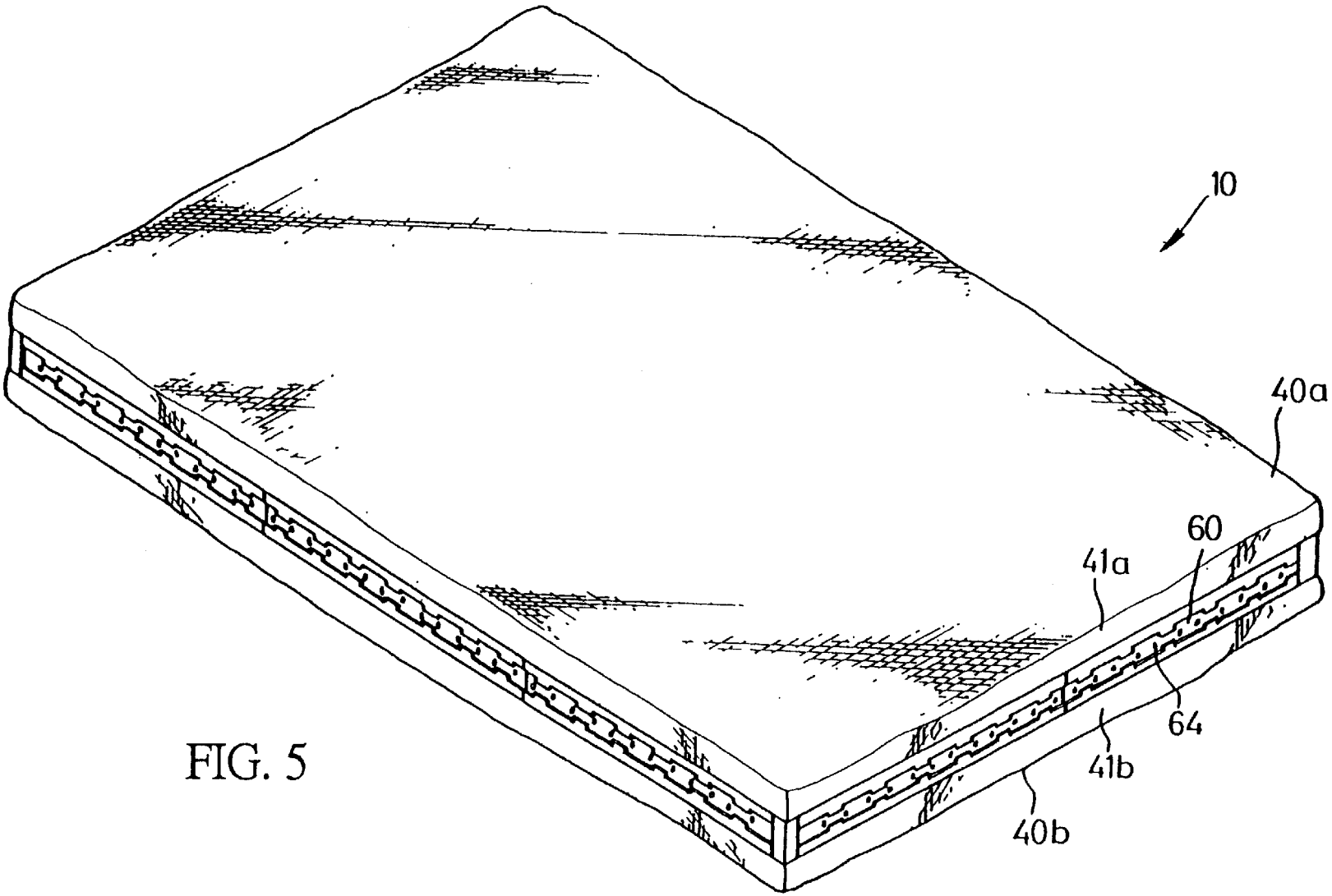
FIG. 5 is a top perspective view of a prior art mattress, partly in cross-section.
Figure 6:
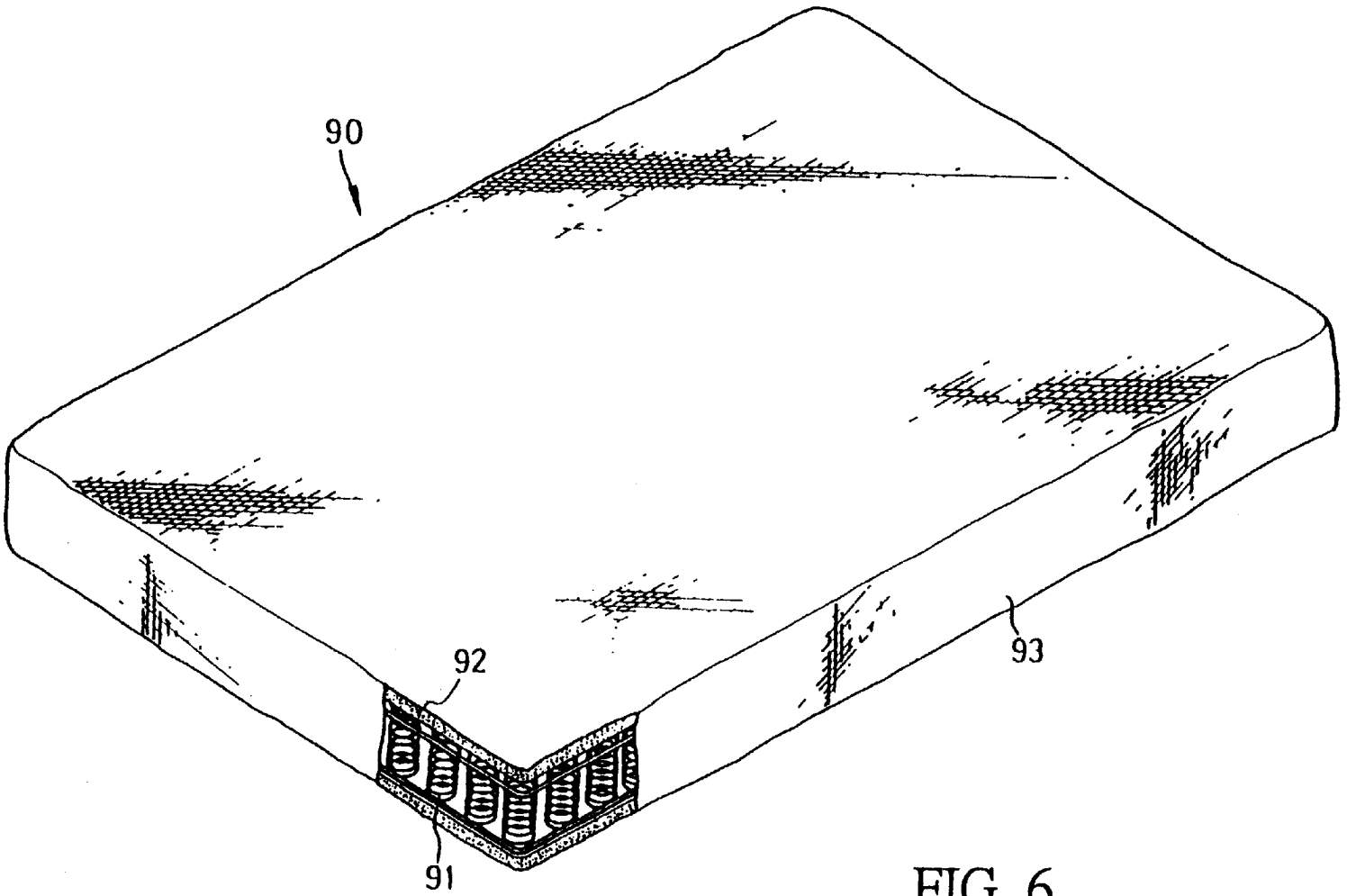
FIG. 6 (PRIOR ART)
FIG. 6 is a cross-sectional view of the prior art mattress of FIG. 5.

Referring to FIGS. 3 and 4, the clamps 60 are dimensioned to be received in the recess 201, and each formed with a series of holes 62, each hole 62 being dimensioned to receive a respective one of the studs 21 therethrough The skirt portions 401*a*, 401*b* of the top and bottom cover 40*a*, 40*b* are also formed with a plurality of openings 402*a*, 402*b* each being corresponding to a respective one of the studs 21 for the studs 21 to pass therethrough. Therefore, upon having the studs 21 in turn pass through the openings 402*a*, 402*b* of the skirt portions 401*a*, 402*b* and the holes 62 of the clamps

60, a threaded portion of each stud 21 protruding from the corresponding fitted clamp 60 can threadingly engage with a respective one of a plurality of screw caps 64, whereby the skirt portions 401*a,* 401*b* are clamped in position between the outer surface of the frame 20 and the clamps 60. As a result, each clamp 60 and the top and bottom covers 40*a,* 40*b* are secured to the frame 20. The clamps 60 are fitted to the bed mattress units 10 to extend over a respective joint between adjacent bed mattress units 10, whereby a rigid framework is achieved. Alternatively, laterally adjacent clamps 60 on corresponding adjacent bed mattress units 10 may be spearably fixed together by fasteners for combining a plurality of bed mattress units into the bed mattress assembly of this invention.

In use, the mattress may be turned over occasionally so that the top and bottom buffer pads 30*a,* 30*b* are subjected to equal amounts of wear. The provision of the bed mattress units 10 permits the bed mattress assembly to be conveniently assembled and dismantled for easy storage and transportation. Further, the covers 40*a,* 40*b* are securely yet removably attached to each of the frames 20, thereby enabling easy cleaning, repair and change;

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A bed mattress assembly formed of at least one bed mattress unit, said at least one bed mattress unit comprising:

a frame having an outer surface;

a plurality of springs securely received within the frame;

at least one buffer pad coupled to the frame and supported by said springs, which are disposed under the buffer pad;

at least one cover having a sheet portion fitted over the buffer pad and a skirt portion peripherally attached to the sheet portion and being capable of covering the outer surface of the frame; and clamping means, coupled to the frame, for releasably clamping the skirt portion of the cover between the frame and the clamping means, allowing the cover to be retained in position relative to the frame, wherein the clamping means are adapted to allow said at least one bed mattress unit to be detachably secured to at least one other bed mattress unit, and the clamping means are each formed with a plurality of holes for receiving a plurality of corresponding studs extending from the outer surface of the frame, allowing a plurality of nuts to threadingly engage with the respective studs and bear against the clamping means, wherein at least one of the clamping means extends between two adjacent bed mattress units.

2. The bed mattress assembly as claimed in claim 1, wherein two adjacent bed mattress units are detachably fixed together by fasteners coupled to two adjacent clamping means on the two adjacent bed mattress units.

3. The bed mattress assembly as claimed in claim 1, wherein a plurality of recesses are formed on the outer surface of the frame, allowing the clamping means to be engaged therewith so as to clamp the skirt portion of the cover between the frame and the clamping means.

* * * * *